United States Patent [19]

Hölss et al.

[11] Patent Number: 4,832,564

[45] Date of Patent: May 23, 1989

[54] PUMPS

[75] Inventors: Kurt Hölss, Huettenberg; Heinrich Lotz, Wetzlar, both of Fed. Rep. of Germany

[73] Assignee: Arthur Pfeiffer Vakuumtechnik Wetzlar GmbH

[21] Appl. No.: 209,498

[22] Filed: Jun. 20, 1988

[30] Foreign Application Priority Data

Jul. 4, 1987 [DE] Fed. Rep. of Germany ..... 3722164

[51] Int. Cl.[4] ..... F01D 1/26

[52] U.S. Cl. ..... 415/90; 415/199.5; 415/914

[58] Field of Search ..... 415/90, 56, 59, 190, 415/199.5, DIG. 1

[56] References Cited

U.S. PATENT DOCUMENTS 4,111,595 9/1978 Becker et al. ..... 415/90
4,456,433 6/1984 Henning et al. ..... 415/90
4,550,593 11/1985 Reich ..... 415/90
4,673,331 6/1987 Kolb ..... 415/DIG. 1

FOREIGN PATENT DOCUMENTS 2214702 9/1973 Fed. Rep. of Germany ..... 415/90
504214 4/1939 United Kingdom ..... 415/DIG. 1

*Primary Examiner*—Robert E. Garrett
*Assistant Examiner*—John T. Kwon
*Attorney, Agent, or Firm*—Toren, McGeady & Associates

[57] ABSTRACT

A turbo-molecular pump has stator discs 2 separated from one another by spacer rings 3 constructed in such a manner that gases streaming back can re-enter the suction space 8 through reduced portions 5 at the outer diameter and through radial recesses 6. Inner reduced portions 7 serve for the additional location of the stator discs 2.

5 Claims, 3 Drawing Sheets

PUMPS

The invention relates to a pump and more particularly to a turbo-molecular pump with interleaved rotor and stator discs, the stator discs being separated from one another by spacer rings.

Rotor and stator discs of turbo-molecular pumps generally each consist of an inner supporting ring which is equipped with blades at the outside. The blades of the rotor discs, which rotate at high speed, produce the pumping effect in cooperation with the stator blades. By means of spacer rings which lie between the stator discs at the outer circumference, the stator discs are kept spaced apart so that the rotor discs can rotate between them without contact. Thus stator discs and spacer rings together form the stator which is centred by the inner wall of the pump housing.

The space which is bounded by the inner wall of the pump housing on the one hand and stator discs and spacer rings on the other hand represents an extremely critical place with regard to back streaming in turbo-molecular pumps. Since an extremely high pressure ratio of the magnitude of many powers of ten (for example $10^{-10}$) is built up between the partial or fore-vacuum side and the high vacuum side of the pump during operation, tiny amounts of gas are sufficient to reduce the pressure ratio and hence the ultimate vacuum of the pump by orders of magnitude. Even if the inner wall of the pump housing and the outer surfaces of the stator discs and of the spacer rings are machined most carefully at great expense, it is impossible to prevent small amounts of gas from reaching the high vacuum side counter to the pumping direction via the inevitable residual interstices.

The construction of a stator for a turbo-molecular pump, which consists essentially of stator discs and spacer rings, is described in DE-AS 25 23 390. During construction, openings are formed in the stator blade rings which are between the spacer rings. Pins, which fix the spacing between adjacent spacer rings, project through these openings. Thus the space between the inner wall of the housing on the one hand and stator discs and spacer rings on the other hand is connected to the suction space through the stator discs. As a result, the gas which flows from the fore-vacuum side to the high vacuum side counter to the pumping direction can be pumped out again before it reaches the high vacuum side.

The construction illustrated in DE-AS 25 23 390 represents a complicated and expensive solution of the problem of stacking stator discs and spacer rings precisely and at the same time preventing back streaming. Apart from the milling of the recesses in the stator discs in a separate operation, the pins, for example, which fix the spacing of the spacer rings, have to be very accurately manufactured and fitted to the spacer rings. This is all the more critical since the inaccuracies in pins and spacer rings add up during the stacking. During the securing of the pins in holes in the spacer rings, tiny cavities result in which, under elevated pressure, small amounts of gas are occluded which later become free again when the pump is in operation and impair the vacuum. A further disadvantage consists in that a stator disc and a spacer ring are always present alternately at the outer edge of the stator. At the places where the stator discs border on the inner wall of the housing, the conductance for the back streaming is particularly great since these do not bear closely against the inner wall of the housing over the whole area like the spacer rings.

From DE-OS 22 14 702, it is known to prevent back streaming by sealing rings which are fitted between the inner wall of the pump housing and the stator at various places. This is an unsuitable solution for the production of a high or ultra-high vacuum, however, because these sealing rings give off gas. In addition, there are problems at elevated temperatures because turbo-molecular pumps are generally heated in order to produce a satisfactory vacuum.

The present invention seeks to provide a stator for a turbo-molecular pump which meets the requirements of a reliable and precise running of the rotor and of an effective reduction in the back streaming. In addition, a simpler and cheaper manufacture of the spacer rings and of the stator discs and a less complicated assembly of the whole pump unit are to be achieved in comparison with the prior art.

According to the present invention, there is provided a pump having interleaved rotor and stator discs in a housing, the stator discs being separated from one another by spacer rings, wherein the spacer rings have reduced portions extending all round at the outer diameter on one or both axial faces whereby ducts are formed between the spacer rings and the inside of the wall of the housing, and on one or both axial faces of the spacer rings there are recesses extending in the radial direction which establish communication between the ducts and the suction space of the pump.

As a result of spacer rings thus provided, the effect is achieved that the stator discs are located with precisely defined spacing so that the rotor discs can rotate between them reliably and precisely. The ducts, which are at the circumference of the stator after assembly, between this and the inner wall of the pump housing, serve as spaces in which the gas streaming back collects. As a result of the radial recesses, the gas enters the suction space between stator and rotor discs and so can be conveyed back to the fore-vacuum. The total conductance for the back streaming is reduced since the outer surfaces of the spacer rings are not separated alternately by the portion of the stator discs which is formed by blades, which cause a high conductance for the back streaming in this region. The rings with the reduced portions and radial recesses can be produced from a tube by the necessary tools on a lathe during a single chucking operation.

In preferred arrangements, the stator discs are held in reduced portions at the inner diameter of the spacer rings. As a result of this, it is possible for the radius of the stator discs to be somewhat smaller than the radius of the inner reduced portions which is an advantage in the event of thermal expansion of the stator. In this case, difficulties arise with the stator construction of conventional type since here the stator discs have to reach directly to the inside of the wall of the pump housing in order to reduce the back streaming.

In a preferred construction, stamped stator discs, which have a thin supporting ring at the outer diameter, are held between the spacer rings. In order to reduce the back streaming between rotor and stator discs in the region between the outer edge of the stator discs and the stator blades of solid construction, this region projects into reduced portions extending all round at the inner diameter of the spacer rings. The stator discs may be additionally located in this region between the spacer rings for the purpose of installed position and stability.

Preferred embodiments of the present invention will now be described, by way of example only, with reference to the accompanying drawings, of which:

Figure 1:
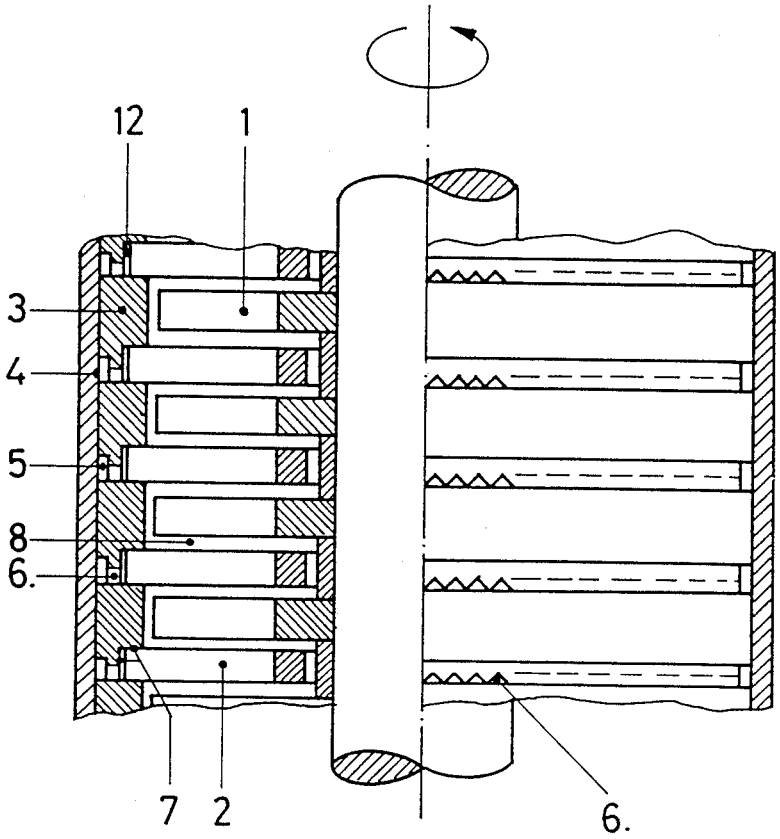
FIG. 1 shows an arrangement according to a first embodiment of the present invention wherein the stator discs are held in reduced portions of the spacer rings.
Figure 2:
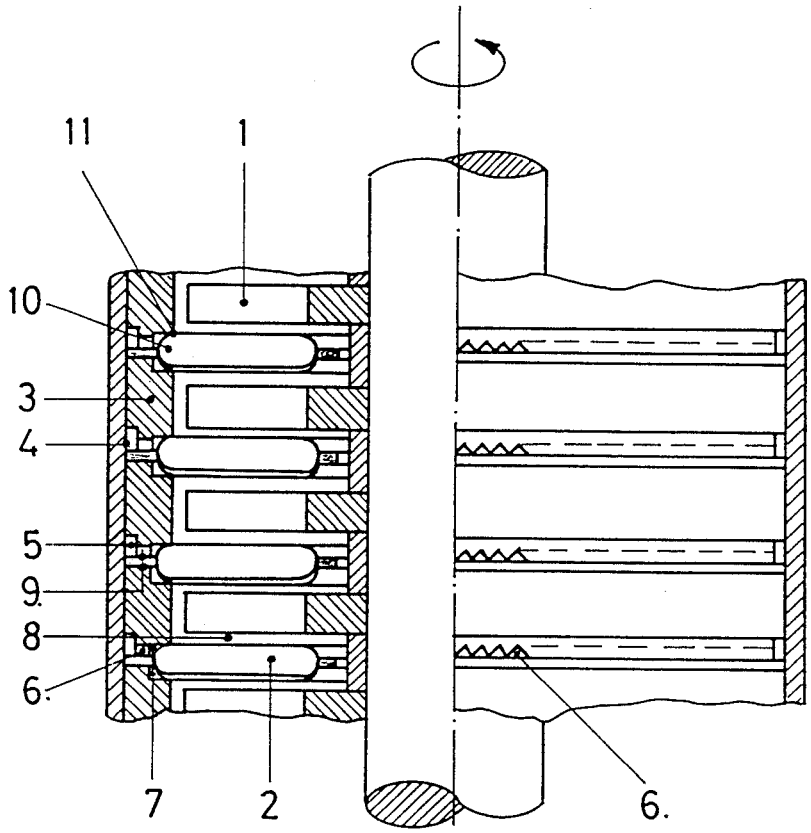
FIG. 2 shows an arrangement according to a second embodiment of the present invention wherein the stator discs are held between the faces of the spacer rings.
Figure 3:
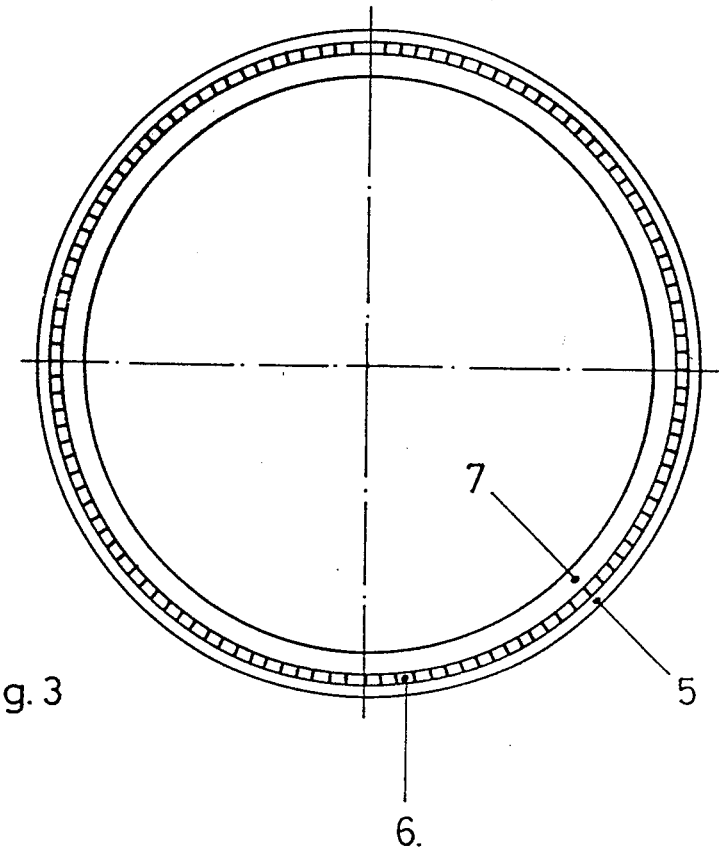
FIG. 3 shows a spacer ring in plan view.
Figure 4:
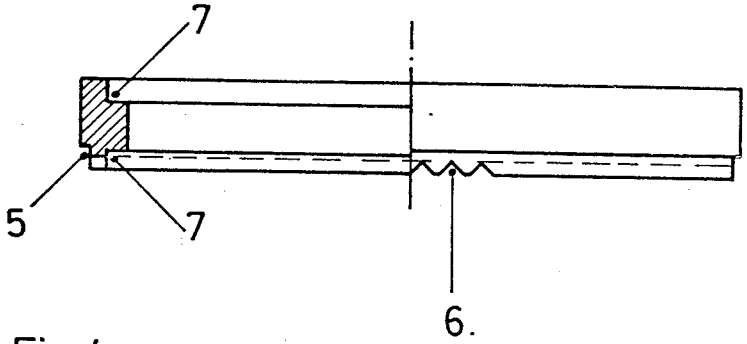
FIG. 4 shows a spacer ring in section and in side view.

FIGS. 1 and 2 show, on the left in section and on the right in elevation, a portion of the interior of a turbomolecular pump. The rotor discs are designated by 1 and the stator discs by 2. The stator discs are separated by spacer rings 3. Thus stator discs and spacer rings together form the stator which is centred on the inner wall 4 of the pump housing. The spacer rings have reduced portions 5 extending all round at the outer diameter on one or both end faces. These reduced portions form ducts between the spacer rings and the inner wall of the housing, which ducts are connected to the suction space 8 by radial recesses 6.

In the embodiment illustrated in FIG. 1, stator discs 2 are used which have been produced by milling for example and the blades of which reach as far as the outer edge. These discs are axially and radially located by reduced portions 7 at the inner diameter of the spacer rings 3. At the same time, a gap 12 remains between the inner diameter of the reduced portions and the outer diameter of the stator discs to take up thermal expansion.

In the embodiment illustrated in FIG. 2, stator discs 2 are used which have been produced from thin sheet metal by stamping for example. These are surrounded by an outer flat edge 9 and by a transition region 10 between this and the blades of solid construction. This outer flat edge is held between the faces of the spacer rings 3. The transition region 10 projects into the reduced portions 7 extending all round at the inner diameter of the spacer rings. The stator discs 2 may be additionally located at the point of the largest diameter 11 of the blades of solid construction.

The reduced portions 5 and 7 extending all round at the outer diameter and at the inner diameter are illustrated with a rectangular cross-section in the embodiments shown and the radial recesses 6 are illustrated with a triangular cross-section. The reduced portions 5 and 7 and the recesses 6 may, however, also have any other cross-section.

We claim:

1. A pump having interleaved rotor and stator discs in a housing, the stator discs being separated from one another by spacer rings, wherein the spacer rings have reduced portions extending all round at the outer diameter on one or both axial faces whereby ducts are formed between the spacer rings and the inside of the wall of the housing, and on one or both axial faces of the spacer rings there are recesses extending in the radial direction which establish communication between the ducts and the suction space of the pump.

2. A pump according to claim 1, wherein the spacer rings have further reduced portions extending all round at the inner diameter on one or both axial faces, which portions receive the stator discs by the outer end of their blades.

3. A pump according to claim 1 or 2, wherein the stator discs are held by their outer edge between the faces of the spacer rings.

4. A pump according to claim 2, wherein a transition region of each stator disc between its outer edge and its blade projects into the reduced portions extending all round at the inner diameter of the spacer rings.

5. A pump according to claim 2, wherein at the point of the largest diameter of the blades, the stator discs are held in the reduced portions extending all round at the inner diameter of the spacer rings.

* * * * *